US006702935B2

(12) United States Patent
Cash et al.

(10) Patent No.: US 6,702,935 B2
(45) Date of Patent: Mar. 9, 2004

(54) HYDROCRACKING PROCESS TO MAXIMIZE DIESEL WITH IMPROVED AROMATIC SATURATION

(75) Inventors: Dennis R. Cash, Novato, CA (US); Arthur J. Dahlberg, Benicia, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 271 days.

(21) Appl. No.: 10/028,557

(22) Filed: Dec. 19, 2001

(65) Prior Publication Data

US 2003/0111385 A1 Jun. 19, 2003

(51) Int. Cl.[7] ..... C10G 65/12

(52) U.S. Cl. ..... 208/58; 208/97; 208/107; 208/142; 208/61

(58) Field of Search ..... 208/58, 97, 107, 208/142, 61

(56) References Cited

U.S. PATENT DOCUMENTS

| | | | | |
|---|---|---|---|---|
| 3,592,757 A | * | 7/1971 | Baral | 208/58 |
| 5,114,562 A | * | 5/1992 | Haun et al. | 208/89 |
| 6,224,747 B1 | * | 5/2001 | Cash et al. | 208/58 |

* cited by examiner

*Primary Examiner*—Walter D. Griffin
*Assistant Examiner*—James Arnold, Jr.
(74) *Attorney, Agent, or Firm*—Penny L. Prater

(57) ABSTRACT

A VGO stream is initially hydrocracked in a hydrocracking reaction zone within an integrated hydroconversion process. Effluent from the hydrocracking reaction zone is combined with a light aromatic-containing feed stream, and the blended stream hydrotreated in a hydrotreating reaction zone. Heat exchange occurs between the hydrocracking reaction zone and the hydrotreating reaction zone, permitting the temperature control of the initial hydrocracking zone. The integrated reaction system provides a single hydrogen supply and recirculation system for use in two reaction processes.

16 Claims, 2 Drawing Sheets

HYDROCRACKING PROCESS TO MAXIMIZE DIESEL WITH IMPROVED AROMATIC SATURATION

BACKGROUND OF THE INVENTION

Much of refinery processing involves reaction of refinery streams in a hydrogen atmosphere. In order to maximize conversion efficiencies and to maintain catalyst life, excess hydrogen is generally used in the catalytic conversion processes, with the unreacted hydrogen being recovered, purified and repressurized for use as a recycle stream. Such recycle processes are costly, both in energy and in equipment. Some progress has been made in developing methods for using a single hydrogen loop in a reaction process having at least two stages.

In conventional hydroprocessing, it is necessary to transfer hydrogen from a vapor phase into the liquid phase where it will be available to react with a petroleum molecule at the surface of the catalyst. This is accomplished by circulating very large volumes of hydrogen gas and the oil through a catalyst bed. The oil and the hydrogen flow through the bed and the hydrogen is absorbed into a thin film of oil that is distributed over the catalyst. Because the amount of hydrogen required can be large, 1000 to 5000 SCF/bbl of liquid, and the amount of catalyst required can also be large, the reactors are very large and can operate at severe conditions, from a few hundred psi to as much as 5000 psi and temperatures from around 400° F. to 900° F.

U.S. Pat. No. 6,224,747 teaches hydrocracking a VGO stream in a hydrocracking reaction zone within an integrated hydroconversion process. Effluent from the hydrocracking reaction zone is combined with a light aromatic-containing feed stream, and the blended stream hydrotreated in a hydrotreating reaction zone. The hydrocracked effluent serves as a heat sink for the hydrotreating reaction zone. The integrated reaction system provides a single hydrogen supply and recirculation system for use in two reaction systems. There is no temperature control between the hydrocracking reaction zone and the hydrotreating reaction zone, however.

U.S. Pat. No. 3,592,757 (Baral) illustrates temperature control between zones by means of heat exchangers, as in the instant invention. Baral does not employ a single hydrogen loop, as does the instant invention. Baral discloses a hydrofiner (similar to a hydrotreater) operating in series with a hydrocracker, with a fraction of the product fed to a hydrogenator. A gas oil feed is fed with both make-up and recycle hydrogen to a hydrofiner. A recycle stream and additional recycle hydrogen are added to the hydrofiner product stream, and the mixture is fed to a hydrocracker. The hydrocracker product stream is cooled and separated into a vapor and a liquid stream. The vapor stream is passed to a recycle hydrogen compressor recycle to the hydrofiner. The liquid stream is fractionated into a top, middle, and bottom stream. The bottom stream is recycled to the hydrocracker. The middle stream is mixed with hydrogen from a make-up hydrogen compressor and directed to a hydrogenator. Hydrogen recovered from the hydrogenator is compressed in a stage of the make-up hydrogen compressor and directed to the hydrofiner.

U.S. Pat. No. 5,114,562 (Haun et al.) teaches a two-stage hydrodesulfurization (similar to hydrotreating) and hydrogenation process for distillate hydrocarbons. There is heat exchange between the two stages, but a single hydrogen loop is not employed. Two separate reaction zones are employed in series, the first zone for hydrodesulfurization and a second zone for hydrogenation. A feed is mixed with recycled hydrogen and fed to a desulfurization reactor. Hydrogen sulfide is stripped from the desulfurization reactor product by a countercurrent flow of hydrogen. The liquid product stream from this stripping operation is mixed with relatively clean recycled hydrogen and the mixture is fed to a hydrogenation reaction zone. Hydrogen is recovered from the hydrogenation reactor and recycled as a split stream to both the desulfurization reactor and the hydrogenation reactor. The hydrogen from the stripping operation is passed through a separator, mixed with the portion of the recycled hydrogen directed to the hydrogenation reactor, compressed, passed through a treating step and recycled to the hydrogenation reactor. Thus, the hydrocarbon feed stream passes in series through the desulfurization and hydrogenation reactors, while relatively low pressure hydrogen is provided for the desulfurization step and relatively high pressure hydrogen is provided for the hydrogenation step.

The instant invention is directed to temperature control between hydrocracking and hydrotreating zones, employing a single hydrogen loop.

SUMMARY OF THE INVENTION

A VGO stream is initially hydrocracked in a first-stage hydrocracking reaction zone within an integrated hydroconversion process. The integrated hydroconversion process possesses at least one hydrocracking stage and at least one hydrotreating stage. Effluent from the first-stage hydrocracking reaction zone is combined with a light aromatic-containing feed stream, and the blended stream is hydrotreated in a second stage, which comprises a hydrotreating reaction zone. Heat exchange occurs between the first-stage hydrocracking reaction zone and the second-stage hydrotreating reaction zone, permitting the temperature control of the first-stage hydrotreating zone. The temperature of the first-stage hydrotreater is lower than that of the first-stage hydrocracker. This improves the aromatic saturation of the converted hydrocarbons and also allows the catalyst of the first-stage hydrotreating zone to be different from the catalyst in subsequent hydrocracking zones that may be present. In one embodiment, the effluent from the first-stage hydrotreater is heated in an exchanger, then passed to a hot high pressure separator, where overhead light ends are removed and passed to a cold high pressure separator. In the cold high pressure separator, hydrogen and hydrogen sulfide gas is removed overhead and materials boiling in the gasoline and diesel range are passed to a fractionator. Hydrogen sulfide is subsequently removed in an absorber and hydrogen is compressed and recirculated to be used as interbed quench, as well as mixed with vacuum gas oil feed.

The liquid effluent of the hot high pressure separator, which may contain materials boiling in the diesel range, is also passed to the fractionator. The fractionator bottoms may be subsequently hydrocracked and products may be subsequently hydrotreated in units not depicted.

This invention offers several notable benefits. The invention provides a method for hydroprocessing two refinery streams using a single hydrogen supply and a single hydrogen recovery system. Furthermore, the instant invention provides a method for hydrocracking a refinery stream and hydrotreating a second refinery stream with a common hydrogen feed supply. The feed to the hydrocracking reaction zone is not poisoned with contaminants present in the feed to the hydrotreating reaction zone. The present invention is further directed to hydroprocessing two or more dissimilar refinery streams in an integrated hydroconversion process while maintaining good catalyst life and high yields of the desired products, particularly distillate range refinery products. Such dissimilar refinery streams may originate from different refinery processes, such as a VGO, derived from the effluent of a VGO hydrotreater, which contains relatively few catalyst contaminants and/or aromatics, and an FCC cycle oil or straight run diesel, which contains substantial amounts of aromatic compounds.

DETAILED DESCRIPTION OF THE INVENTION

Figure 1:
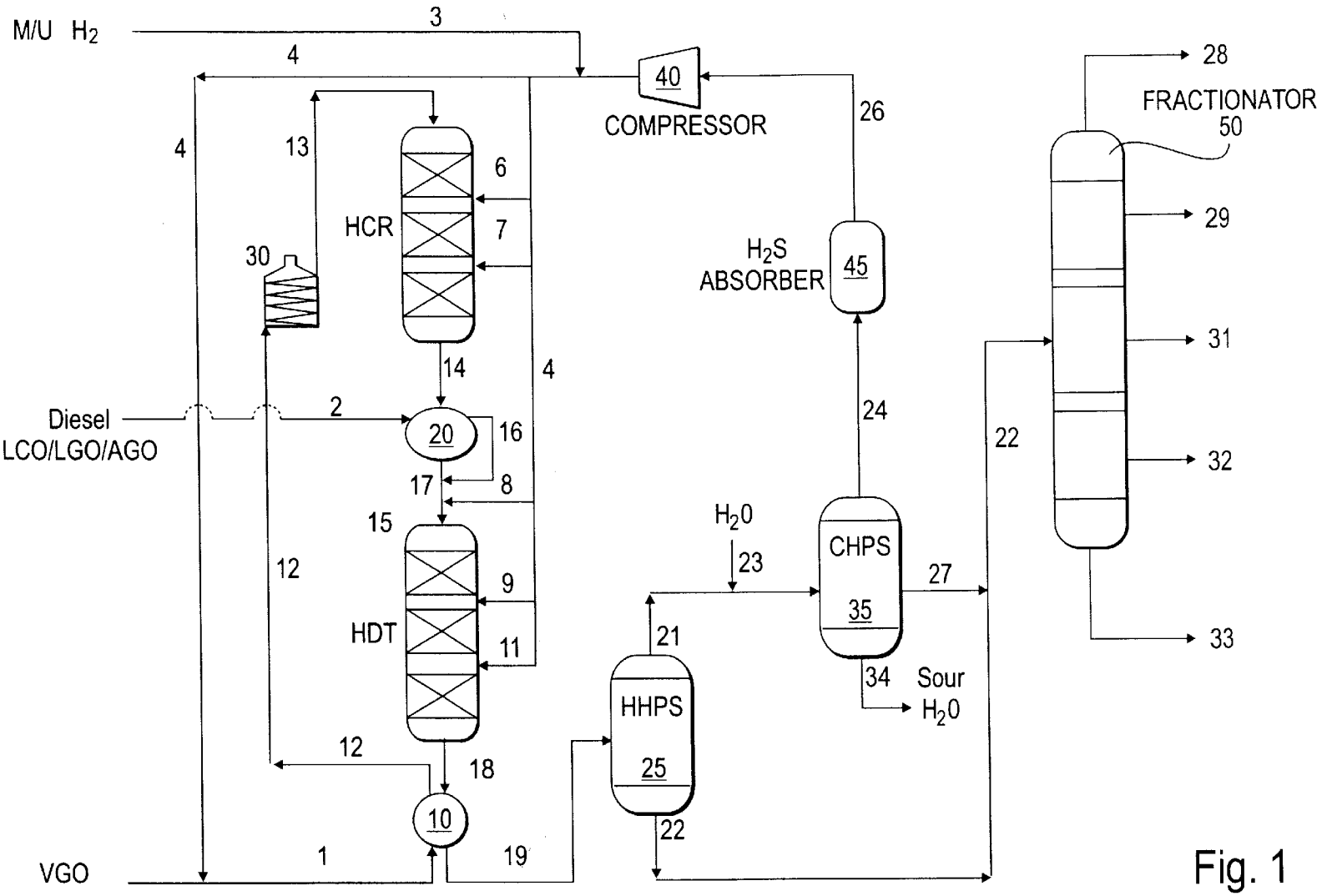
FIG. 1 illustrates a hydrocracker and hydrotreater in series, in a single hydrogen loop separated by a heat exchanger. Light and heavy materials are separated from each other. Hydrogen and hydrogen sulfide might be removed from the light products. Hydrogen is compressed and recirculated. Products are sent to a fractionator.

This invention relates to two reaction processes, using two dissimilar feeds, which are combined into a single integrated reaction process, using a single hydrogen supply and recovery system. In the process, a heavier feed is hydrocracked to make a middle distillate and/or gasoline product, and a lighter feed is hydrotreated to upgrade the fuel properties of the lighter feed. The process is particularly useful for treating a second refinery stream which boils in a temperature range generally below that of the first refinery stream, or a feedstream which is to be treated to remove aromatics before being processed further.

In one embodiment of the process, a first refinery stream such as a VGO is hydrocracked in the presence of hydrogen over a hydrocracking catalyst contained in a first-stage hydrocracking zone at conditions sufficient to remove at least a portion of the nitrogen compounds from the first refinery stream and to effect a boiling range conversion. The entire effluent from the first reaction zone is then heat exchanged with an incoming stream, then combined with a second refinery stream. The combined feedstock, along with optional additional hydrogen-rich gas, is passed to a second-stage reaction zone, which is maintained at hydrotreating conditions sufficient to remove at least a portion of the aromatic compounds from the second refinery stream. The feedstocks may flow through one or both of the reaction zones in gravity flow in a downwardly direction or upwardly against gravity. The process is in contrast to a conventional practice of combining the second refinery stream with the first refinery stream and hydrocracking the combination together. Alternative conventional practice would treat the two feedstocks in separate processes, with separate hydrogen supply, recovery and recycle systems.

The effluent from the first hydrotreating zone is heat exchanged with incoming VGO feed, then hydrogen is removed in a separator. The effluent then passes to a fractionator, with bottoms passing to another hydrocracking zone (not depicted) and diesel passing to another hydrotreating zone (not depicted).

In an alternate embodiment, separation may occur following the first hydrocracking stage. Liquid effluent may pass to fractionation, and lighter materials are combined with a light aromatic feed and subsequently hydrotreated. Hydrogen is separated from the hydrotreated effluent and recirculated. Products are sent to a fractionator.

Feed and Effluent Characteristics—Hydrocracking Stage

A VGO is a preferred first refinery stream, and a synthetic or straight run middle distillate is a preferred second refinery stream. A suitable synthetic middle distillate, formed by cracking a heavier stock, may contain high nitrogen levels. The second refinery stream, which is added to the hydrocracking effluent before it enters the hydrotreating zone, generally boils in the middle distillate boiling range, and is hydrotreated to remove nitrogen and/or aromatics, without excessive cracking. The preferred first stage contains hydrocracking catalyst, maintained at hydrocracking conditions. Likewise, the preferred second stage contains hydrotreating catalyst, maintained at hydrotreating reaction conditions. In the process, the first and the second stages are contained in two closely coupled reactor vessels, separated by a heat exchanger, having a single integrated hydrogen supply and recovery system serving both stages. The process serves to prevent contaminants present in the second refinery stream from fouling the catalyst in the first reaction zone.

One suitable first refinery stream is a VGO having a boiling point range starting at a temperature above 500° F. (260° C.), usually within the temperature range of 500° F.–1100° F. (260° C.–593° C.). A refinery stream wherein 75 vol % of the refinery stream boils within the temperature range 650° F.–1050° F. is an example feedstock for the first reaction zone. The first refinery stream may contain nitrogen, usually present as organonitrogen compounds. VGO feed streams for the first reaction zone contain less than about 200 ppm nitrogen and less than 0.25 wt. % sulfur, though feeds with higher levels of nitrogen and sulfur, including those containing up to 0.5 wt. % and higher nitrogen and up to 5 wt. % sulfur and higher may be treated in the present process. The first refinery stream is also preferably a low asphaltene stream. Suitable first refinery streams contain less than about 500 ppm asphaltenes, preferably less than about 200 ppm asphaltenes, and more preferably less than about 100 ppm asphaltenes. Example streams include light gas oil, heavy gas oil, straight run gas oil, deasphalted oil, and the like. The first refinery stream may have been processed, e.g., by hydrotreating, prior to the present process to reduce or substantially eliminate its heteroatom content. The first refinery stream may comprise recycle components.

The hydrocracking reaction step removes nitrogen and sulfur from the first refinery feed stream in the first hydrocracking reaction zone and effects a boiling range conversion, so that the liquid portion of the first hydrocracking reaction zone effluent has a normal boiling range below the normal boiling point range of the first refinery feedstock. By "normal" is meant a boiling point or boiling range based on a distillation at one atmosphere pressure, such as that determined in a D1160 distillation. Unless otherwise specified, all distillation temperatures listed herein refer to normal boiling point and normal boiling range temperatures. The process in the first hydrocracking reaction zone may be controlled to a certain cracking conversion or to a desired product sulfur level or nitrogen level or both. Conversion is generally related to a reference temperature, such as, for example, the minimum boiling point temperature of the hydrocracker feedstock. The extent of conversion relates to the percentage of feed boiling above the reference temperature which is converted to products boiling below the reference temperature.

The hydrocracking reaction zone effluent includes normally liquid phase components, e.g., reaction products and unreacted components of the first refinery stream, and normally gaseous phase components, e.g., gaseous reaction products and unreacted hydrogen. In the process, the hydrocracking reaction zone is maintained at conditions sufficient to effect a boiling range conversion of the first refinery stream of at least about 25%, based on a 650° F. reference temperature. Thus, at least 25% by volume of the components in the first refinery stream which boil above about 650° F. are converted in the first hydrocracking reaction zone to components which boil below about 650° F. Operating at conversion levels as high as 100% is also within the scope of the invention. Example boiling range conversions are in the range of from about 30% to 90% or of from about 40% to 80%. The hydrocracking reaction zone effluent is further decreased in nitrogen and sulfur content, with at least about 50% of the nitrogen containing molecules in the first refinery stream being converted in the hydrocracking reaction zone. Preferably, the normally liquid products present in the hydrocracking reaction zone effluent contain less than about 1000 ppm sulfur and less than about 200 ppm nitrogen, more preferably less than about 250 ppm sulfur and about 100 ppm nitrogen.

Conditions—Hydrocracking Stage

Reaction conditions in the hydrocracking reaction zone include a reaction temperature between about 250° C. and about 500° C. (482° F.–932° F.), pressures from about 3.5 MPa to about 24.2 MPa (500–3,500 psi), and a feed rate (vol oil/vol cat h) from about 0.1 to about 20 $hr^{-1}$. Hydrogen circulation rates are generally in the range from about 350 std liters $H_2$/kg oil to 1780 std liters $H_2$/kg oil (2,310–11,750 standard cubic feet per barrel). Preferred reaction temperatures range from about 340° C. to about 455° C. (644° F.–851° F.). Preferred total reaction pressures range from about 7.0 MPa to about 20.7 MPa (1,000–3,000 psi). With the preferred catalyst system, it has been found that preferred process conditions include contacting a petroleum feedstock with hydrogen under hydrocracking conditions comprising a pressure of about 13.8 MPa to about 20.7 MPa (2,000–3000 psi), a gas to oil ratio between about 379–909 std liters $H_2$/kg oil (2,500–6,000 scf/bbl), a LHSV of between about 0.5–1.5 $hr^{-1}$, and a temperature in the range of 360° C. to 427° C. (680° F.–800° F.).

Catalysts—Hydrocracking Stage

The hydrocracking stage and the hydrotreating stage may each contain one or more catalysts. If more than one distinct catalyst is present in either of the stages, they may either be blended or be present as distinct layers. Layered catalyst systems are taught, for example, in U.S. Pat. No. 4,990,243, the disclosure of which is incorporated herein by reference for all purposes. Hydrocracking catalysts useful for the first stage are well known. In general, the hydrocracking catalyst comprises a cracking component and a hydrogenation component on an oxide support material or binder. The cracking component may include an amorphous cracking component and/or a zeolite, such as a Y-type zeolite, an ultrastable Y type zeolite, or a dealuminated zeolite. A suitable amorphous cracking component is silica-alumina.

The hydrogenation component of the catalyst particles is selected from those elements known to provide catalytic hydrogenation activity. At least one metal component selected from the Group VIII (IUPAC Notation) elements and/or from the Group VI (IUPAC Notation) elements are generally chosen. Group V elements include chromium, molybdenum and tungsten. Group VIII elements include iron, cobalt, nickel, ruthenium, rhodium, palladium, osmium, iridium and platinum. The amount(s) of hydrogenation component(s) in the catalyst suitably range from about 0.5% to about 10% by weight of Group VIII metal component(s) and from about 5% to about 25% by weight of Group VI metal component(s), calculated as metal oxide(s) per 100 parts by weight of total catalyst, where the percentages by weight are based on the weight of the catalyst before sulfiding. The hydrogenation components in the catalyst may be in the oxidic and/or the sulphidic form. If a combination of at least a Group VI and a Group VIII metal component is present as (mixed) oxides, it will be subjected to a sulfiding treatment prior to proper use in hydrocracking. Suitably, the catalyst comprises one or more components of nickel and/or cobalt and one or more components of molybdenum and/or tungsten or one or more components of platinum and/or palladium. Catalysts containing nickel and molybdenum, nickel and tungsten, platinum and/or palladium are particularly preferred.

The hydrocracking catalyst particles of this invention may be prepared by blending, or co-mulling, active sources of hydrogenation metals with a binder. Examples of suitable binders include silica, alumina, clays, zirconia, titania, magnesia and silica-alumina. Preference is given to the use of alumina as binder. Other components, such as phosphorous, may be added as desired to tailor the catalyst particles for a desired application. The blended components are then shaped, such as by extrusion, dried and calcined at temperatures up to 1200° F. (649° C.) to produce the finished catalyst particles. Alternatively, equally suitable methods of preparing the amorphous catalyst particles include preparing oxide binder particles, such as by extrusion, drying and calcining, followed by depositing the hydrogenation metals on the oxide particles, using methods such as impregnation. The catalyst particles, containing the hydrogenation metals, are then further dried and calcined prior to use as a hydrocracking catalyst.

Feed and Effluent Characteristics—Hydrotreater Stage

The second refinery feedstream has a boiling point range generally lower than the first refinery feedstream. Indeed, it is a feature of the present process that a substantial portion of the second refinery feedstream has a normal boiling point in the middle distillate range, so that cracking to achieve boiling point reduction is not necessary. Thus, at least about 75 vol % of a suitable second refinery stream has a normal boiling point temperature of less than about 1000° F. A refinery stream with at least about 75% v/v of its components having a normal boiling point temperature within the range of 250° F.–700° F. is an example of a preferred second refinery feedstream.

The process of this invention is particularly suited for treating middle distillate streams which are not suitable for high quality fuels. For example, the process is suitable for treating a second refinery stream which contains high amounts of nitrogen and/or high amounts of aromatics, including streams which contain up to 90% aromatics and higher. Example second refinery feedstreams which are suitable for treating in the present process include straight run vacuum gas oils, including straight run diesel fractions, from crude distillation, atmospheric tower bottoms, or synthetic cracked materials such as coker gas oil, light cycle oil or heavy cycle oil.

After the first refinery feedstream is treated in the hydrocracking stage, the first hydrocracking reaction zone effluent is combined with the second feedstock, and the combination passed together with hydrogen over the catalyst in the hydrotreating stage. Since the hydrocracked effluent is already relatively free of the contaminants to be removed by hydrotreating, the hydrocracker effluent passes largely unchanged through the hydrotreater. And unreacted or incompletely reacted feed remaining in the effluent from the hydrotreater is effectively isolated from the hydrocracker zone to prevent contamination of the catalyst contained therein.

However, the presence of the hydrocracker effluent plays an important and unexpected economic benefit in the integrated process. Leaving the hydrocracker, the effluent carries with it substantial thermal energy. This energy may be used to heat the second reactor feedstream in a heat exchanger before the second feedstream enters the hydrotreater. This permits adding a cooler second feed stream to the integrated system than would otherwise be required, and saves on furnace capacity and heating costs.

As the second feedstock passes through the hydrotreater, the temperature again tends to increase due to exothermic reaction heating in the second zone. The hydrocracker effluent in the second feedstock serves as a heat sink, which moderates the temperature increase through the hydrotreater. The heat energy contained in the liquid reaction products leaving the hydrotreater is further available for exchange with other streams requiring heating. Generally, the outlet temperature of the hydrotreater will be higher than the outlet temperature of the hydrocracker. In this case, the instant invention will afford the added heat transfer advantage of elevating the temperature of the first hydrocracker feed for more effective heat transfer. The effluent from the hydrocracker also carries the unreacted hydrogen for use in the first-stage hydrotreater without any heating or pumping requirement to increase pressure.

Conditions—Hydrotreater Stage

The hydrotreater is maintained at conditions sufficient to remove at least a portion of the nitrogen compounds and at least a portion of the aromatic compounds from the second refinery stream. The hydrotreater will operate at a lower temperature than the hydrocracker, except for possible temperature gradients resulting from exothermic heating within the reaction zones, moderated by the addition of relatively cooler streams into the one or more reaction zones. Feed rate of the reactant liquid stream through the reaction zones will be in the region of 0.1 to 20 $hr^{-1}$ liquid hourly space velocity. Feed rate through the hydrotreater will be increased relative to the feed rate through the hydrocracker by the amount of liquid feed in the second refinery feedstream and will also be in the region of 0.1 to 20 $hr^{-1}$ liquid hourly space velocity. These process conditions selected for the first reaction zone may be considered to be more severe than those conditions normally selected for a hydrotreating process.

At any rate, hydrotreating conditions typically used in the hydrotreater will include a reaction temperature between about 250° C. and about 500° C. (482° F.–932° F.), pressures from about 3.5 MPa to about 24.2 MPa (500–3,500 psi), and a feed rate (vol oil/vol cat h) from about 0.1 to about 20 $hr^{-1}$. Hydrogen circulation rates are generally in the range from about 350 std liters $H_2$/kg oil to 1780 std liters $H_2$/kg oil (2,310–11,750 standard cubic feet per barrel). Preferred reaction temperatures range from about 340° C. to about 455° C. (644° F.–851° F.). Preferred total reaction pressures range from about 7.0 MPa to about 20.7 MPa (1,000–3,000 psi). With the preferred catalyst system, it has been found that preferred process conditions include contacting a petroleum feedstock with hydrogen in the presence of the layered catalyst system under hydrocracking conditions comprising a pressure of about 16.0 MPa (2,300 psi), a gas to oil ratio at from about 379–909 std liters $H_2$/kg oil (2,500 scf/bbl to about 6,000 scf/bbl), a LHSV of between about 0.5–1.5 $hr^{-1}$, and a temperature in the range of 360° C. to 427° C. (680° F.–800° F.). Under these conditions, at least about 50% of the aromatics are removed from the second refinery stream in the hydrotreater. It is expected that as much as 30–70% or more of the nitrogen present in the second refinery stream would also be removed in the process. However, cracking conversion in the hydrotreater would be generally low, typically less than 20%. Standard methods for determining the aromatic content and the nitrogen content of refinery streams are available. These include ASTM D5291 for determining the nitrogen content of a stream containing more than about 1500 ppm nitrogen. ASTM D5762 may be used for determining the nitrogen content of a stream containing less than about 1500 ppm nitrogen. ASTM D2007 may be used to determine the aromatic content of a refinery stream.

The second reaction stage contains hydrotreating catalyst, maintained at hydrotreating conditions. Catalysts known for hydrotreating are useful for the first-stage hydrotreater. Such hydrotreating catalysts are suitable for hydroconversion of feedstocks containing high amounts of sulfur, nitrogen and/or aromatic-containing molecules. It is a feature of the present invention that the hydrotreating step may be used to treat feedstocks containing asphaltenic contaminants which would otherwise adversely affect the catalytic performance or life of the hydrocracking catalysts. The catalysts in the hydrotreater are selected for removing these contaminants to low values. Such catalysts generally contain at least one metal component selected from Group VIII (IUPAC Notation) and/or at least one metal component selected from the Group VI (IUPAC notation) elements. Group VI elements include chromium, molybdenum and tungsten. Group VIII elements include iron, cobalt and nickel. While the noble metals, especially palladium and/or platinum, may be included, alone or in combination with other elements, in the hydrotreating catalyst, use of the noble metals as hydrogenation components is not preferred. The amount(s) of hydrogenation component(s) in the catalyst suitably range from about 0.5% to about 10% by weight of Group VIII metal component(s) and from about 5% to about 25% by weight of Group VI metal component(s), calculated as metal oxide(s) per 100 parts by weight of total catalyst, where the percentages by weight are based on the weight of the catalyst before sulfiding. The hydrogenation components in the catalyst may be in the oxidic and/or the sulfidic form. If a combination of at least a Group VI and a Group VIII metal component is present as (mixed) oxides, it will be subjected to a sulfiding treatment prior to proper use in hydrocracking. Suitably, the catalyst comprises one or more components of nickel and/or cobalt and one or more components of molybdenum and/or tungsten. Catalysts containing cobalt and molybdenum are particularly preferred.

The hydrotreating catalyst particles of this invention are suitably prepared by blending, or co-mulling, active sources of hydrogenation metals with a binder. Examples of suitable binders include silica, alumina, clays, zirconia, titania, magnesia and silica-alumina. Preference is given to the use of alumina as binder. Other components, such as phosphorous, may be added as desired to tailor the catalyst particles for a desired application. The blended components are then shaped, such as by extrusion, dried and calcined at temperatures up to 1200° F. (649° C.) to produce the finished catalyst particles. Alternatively, equally suitable methods of preparing the amorphous catalyst particles include preparing oxide binder particles, such as by extrusion, drying and calcining, followed by depositing the hydrogenation metals on the oxide particles, using methods such as impregnation. The catalyst particles, containing the hydrogenation metals, are then further dried and calcined prior to use as a hydrotreating catalyst.

The subject process is especially useful in the production of middle distillate fractions boiling in the range of about 250° F.–700° F. (121° C.–371° C.) as determined by the appropriate ASTM test procedure. By a middle distillate fraction having a boiling range of about 250° F.–700° F. is meant that at least 75 vol %, preferably 85 vol %, of the components of the middle distillate have a normal boiling point of greater than about 250° F. and furthermore that at least about 75 vol %, preferably 85 vol %, of the components of the middle distillate have a normal boiling point of less than 700° F. The term "middle distillate" is intended to include the diesel, jet fuel and kerosene boiling range fractions. The kerosene or jet fuel boiling point range is intended to refer to a temperature range of about 280° F.–525° F. (138° C.–274° C.), and the term "diesel boiling range" is intended to refer to hydrocarbon boiling points of about 250° F.–700° F. (121° C-371° C.). Gasoline or naphtha is normally the $C_5$ to 400° F. (204° C.) endpoint fraction of available hydrocarbons. The boiling point ranges of the various product fractions recovered in any particular refinery will vary with such factors as the characteristics of the crude oil source, refinery local markets, product prices, etc. Reference is made to ASTM standards D-975 and D-3699-83 for further details on kerosene and diesel fuel properties.

The effluent of the hydrotreater is subsequently fractionated. The fractionator bottoms may be subjected to subsequent hydrocracking and hydrotreating. The range of conditions and the types of catalysts employed in the subsequent treatments are the same as those which may be employed in the first stage, although catalyst comprising zeolites may be more typically employed.

Reference is now made to FIG. 1, which discloses preferred embodiments of the invention. Not included in the figures are various pieces of auxiliary equipment such as heat exchangers, condensers, pumps and compressors, which are not essential to the invention.

In FIG. 1, two downflow reactor vessels, 5 and 15 are depicted. Between them is heat exchanger 20. Each vessel contains at least one reaction zone. The first-stage reaction, hydrocracking, occurs in vessel 5. The second-stage reaction, hydrotreating, occurs in vessel 15. Each vessel is depicted as having three catalyst beds. The first reaction vessel 5 is for cracking a first refinery stream 1. The second reaction vessel 15 is for removing nitrogen-containing and aromatic molecules from a second refinery stream 17. A suitable volumetric ratio of the catalyst volume in the first reaction vessel to the catalyst volume in the second reaction vessel encompasses a broad range, depending on the ratio of the first refinery stream to the second refinery stream. Typical ratios generally lie between 20:1 and 1:20. A preferred volumetric range is between 10:1 and 1:10. A more preferred volumetric ratio is between 5:1 and 1:2.

In the integrated process, a first refinery stream 1 is combined with a hydrogen-rich gaseous stream 4 to form a first feedstock 12. The stream exiting furnace 30, stream 13, is passed to first reaction vessel 5. Hydrogen-rich gaseous stream 4 contains greater than 50% hydrogen, the remainder being varying amounts of light gases, including hydrocarbon gases. The hydrogen-rich gaseous stream 4 shown in the drawing is a blend of make-up hydrogen 3 and recycle hydrogen 26. While the use of a recycle hydrogen stream is generally preferred for economic reasons, it is not required. First feedstock 1 may be heated in one or more exchangers, such as exchanger 10, emerging as stream 12, and in one or more heaters, such as heater 30, (emerging as stream 13) before being introduced to first reaction vessel 5 in which hydrocracking preferably occurs. Hydrotreating preferably occurs in vessel 15.

Hydrogen may also be added as a quench stream through lines 6 and 7, and 9 and 11, (which also come from hydrogen stream 4) for cooling the first and the second reaction stages, respectively. The effluent from the hydrocracking stage, stream 14 is cooled in heat exchanger 20 by stream 2. Stream 2 boils in the diesel range and may be light cycle oil, light gas oil, atmospheric gas oil, or a mixture of the three. Stream 2 emerges from exchanger 20 as stream 16 and combines stream 14 as it emerges from exchanger 20 to form combined feedstock 17. Hydrogen in stream 8 joins the combined feedstock 17 before it enters vessel 15. Stream 17 enters vessel 15 for hydrotreatment, and exits as stream 18.

The second reaction stage, found in vessel 15, contains at least one bed of catalyst, such as hydrotreating catalyst, which is maintained at conditions sufficient for converting at least a portion of the nitrogen compounds and at least a portion of the aromatic compounds in the second feedstock.

Hydrogen stream 4 may be recycle hydrogen from compressor 40. Alternately, stream 4 may be a fresh hydrogen stream, originating from hydrogen sources external to the present process.

Stream 18, the second reaction zone effluent, contains thermal energy which may be recovered by heat exchange, such as in heat exchanger 10. Second stage effluent 18 emerges from exchanger 10 as stream 19 and is passed to hot high pressure separator 25. The liquid effluent of the hot high pressure separator 25, stream 22 is passed to fractionation. The overhead gaseous stream from separator 25, stream 21, is combined with water from stream 23 for cooling. The now cooled stream 21 enters the cold high pressure separator 35. Light liquids are passed to fractionation in stream 27 (which joins stream 22) and sour water is removed through stream 34. Gaseous overhead stream 24 passes to amine absorber 45, for the removal of hydrogen sulfide gas. Purified hydrogen then passes, through stream 26, to the compressor 40, where it is recompressed and passed as recycle to one or more of the reaction vessels and as a quench stream for cooling the reaction zones. Such uses of hydrogen are well known in the art.

An example separation scheme for a hydroconversion process is taught in U.S. Pat. No. 5,082,551, the entire disclosure of which is incorporated herein by reference for all purposes.

The absorber 45 may include means for contacting a gaseous component of the reaction effluent 19 with a solution, such as an alkaline aqueous solution, for removing contaminants such as hydrogen sulfide and ammonia which may be generated in the reaction stages and may be present in reaction effluent 19. The hydrogen-rich gaseous stream 24 is preferably recovered from the separation zone at a temperature in the range of 100° F.–300° F. or 100° F.–200° F.

Liquid stream 22 is further separated in fractionator 50 to produce overhead gasoline stream 28, naphtha stream 29, kerosene fraction 31, diesel stream 32 and fractionator bottoms 33. A preferred distillate product has a boiling point range within the temperature range 250° F.–700° F. A gasoline or naphtha fraction having a boiling point range within the temperature range $C_5$–400° F. is also desirable.

Figure 2:
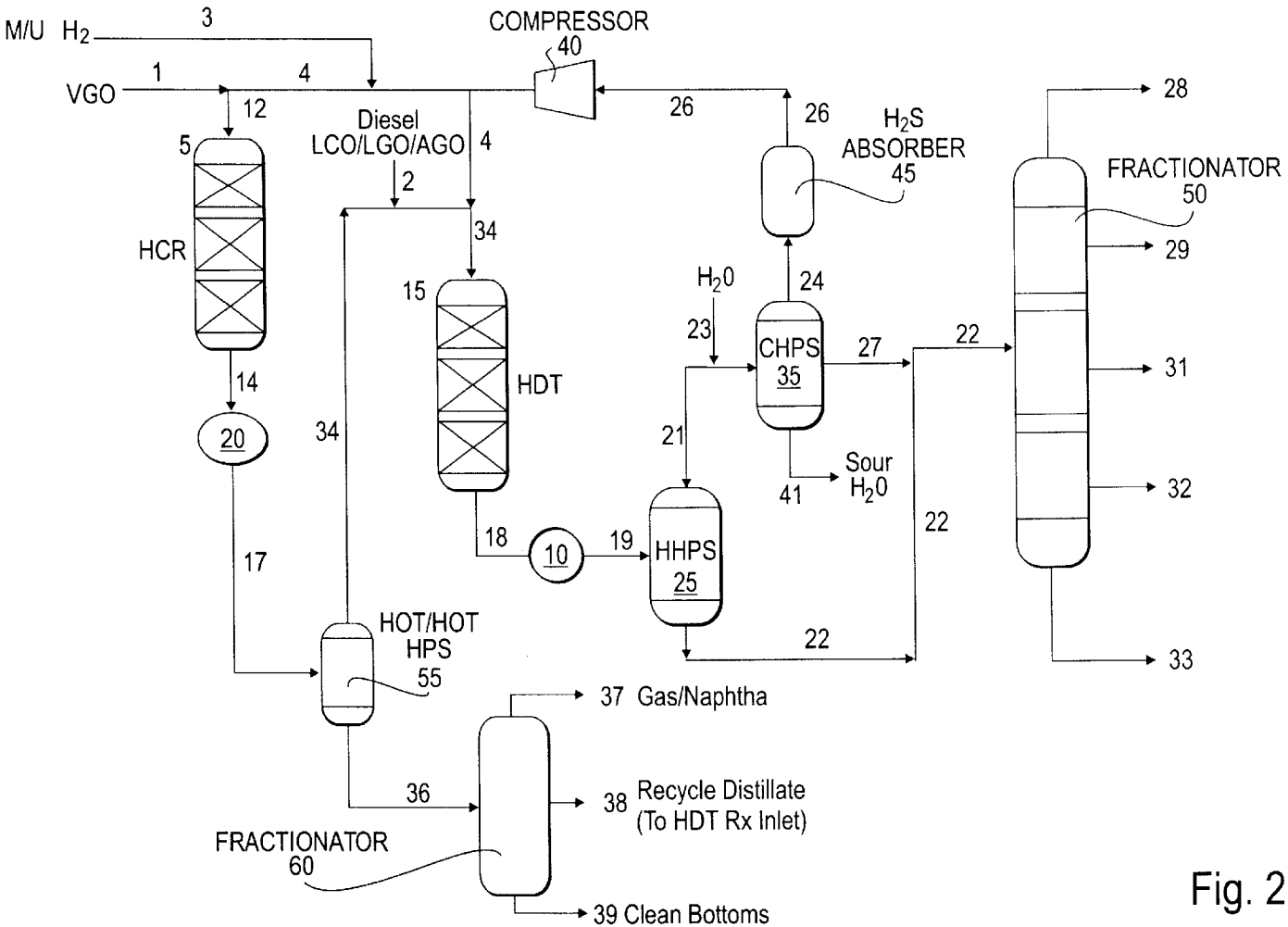
FIG. 2 illustrates a hydrocracking step followed by separation and fractionation. Material removed overhead is combined with a light aromatic stream and hydrotreated. Hydrogen is separated from the hydrotreated effluent and recirculated. Products are sent to a fractionator.

In FIG. 2, two downflow reactor vessels, 5 and 15, are depicted. The first stage reaction, hydrocracking, occurs in vessel 5. The second stage, hydrotreating, occurs in vessel 15. Each vessel contains at least one reaction zone. Each vessel is depicted as having three catalyst beds. The first reaction vessel 5 is for cracking a first refinery stream 1. The second reaction vessel 15 is for removing nitrogen-containing and aromatic molecules from a second refinery stream 34. A suitable volumetric ratio of the catalyst volume in the first reaction vessel to the catalyst volume in the second reaction vessel encompasses a broad range, depending on the ratio of the first refinery stream to the second refinery stream. Typical ratios generally lie between 20:1 and 1:20. A preferred volumetric range is between 10:1 and 1:10. A more preferred volumetric ratio is between 5:1 and 1:2.

In the integrated process, a first refinery stream 1 is combined with a hydrogen-rich gaseous stream 4 to form a first feedstock 12 which is passed to first reaction vessel 5. Hydrogen-rich gaseous stream 4 contains greater than 50% hydrogen, the remainder being varying amounts of light gases, including hydrocarbon gases. The hydrogen-rich gaseous stream 4 shown in the drawing is a blend of make-up hydrogen 3 and recycle hydrogen 26. While the use of a recycle hydrogen stream is generally preferred for economic reasons, it is not required. First feedstock 1 may be heated in one or more exchangers or in one or more heaters before being combined with hydrogen-rich stream 4 to create stream 12. Stream 12 is then introduced to first reaction vessel 5, where the first stage, in which hydrocracking preferably occurs, is located. The second stage is located in vessel 15, where hydrotreating preferably occurs.

The effluent from the first stage, stream 14 is heated in heat exchanger 20. Stream 14 emerges from exchanger 20 as stream 17 and passes to the "hot/hot" high pressure separator 55. The liquid stream 36 emerges from the "hot/hot" high pressure separator 55 and proceeds to fractionator 60. Stream 37 represents products streams for gasoline and naphtha, stream 38 represents distillate recycled back to the inlet of hydrotreater 15, and stream 39 represents clean bottoms material.

The gaseous stream 34 emerges from the "hot/hot" high pressure separator 55, and joins with stream 2, which boils in the diesel range and may be light cycle oil, light gas oil, atmospheric gas oil, or a mixture of the three. It further combines with hydrogen-rich stream 4 prior to entering vessel 15 for hydrotreatment, and exits as stream 18.

The second reaction zone, found in vessel 15, contains at least one bed of catalyst, such as hydrotreating catalyst, which is maintained at conditions sufficient for converting at least a portion of the nitrogen compounds and at least a portion of the aromatic compounds in the second feedstock.

Hydrogen stream 4 may be recycle hydrogen from compressor 40. Alternately, stream 4 may be a fresh hydrogen stream, originating from hydrogen sources external to the present process.

Stream 18, the second stage effluent, contains thermal energy which may be recovered by heat exchange, such as in heat exchanger 10. Second stage effluent 18 emerges from exchanger 10 as stream 19 and is passed to hot high pressure separator 25. The liquid effluent of the hot high pressure separator 25, stream 22 is passed to fractionation. The overhead gaseous stream from separator 25, stream 21, is combined with water from stream 23 for cooling. The now cooled stream 21 enters the cold high pressure separator 35. Light liquids are passed to fractionation in stream 27 (which joins stream 22) and sour water is removed through stream 41. Gaseous overhead stream 24 passes to amine absorber 45, for the removal of hydrogen sulfide gas. Purified hydrogen then passes, through stream 26, to the compressor 40, where it is recompressed and passed as recycle to one or more of the reaction vessels and as a quench stream for cooling the reaction zones. Such uses of hydrogen are well known in the art.

The absorber 45 may include means for contacting a gaseous component of the reaction effluent 19 (stream 24) with a solution, such as an alkaline aqueous solution, for removing contaminants such as hydrogen sulfide and ammonia which may be generated in the reaction zones and may be present in reaction effluent 19. The hydrogen-rich gaseous stream 24 is preferably recovered from the separation zone at a temperature in the range of 100° F.–300° F. or 100° F.–200° F.

Liquid stream 22 is further separated in fractionator 50 to produce overhead gasoline stream 28, naphtha stream 29, kerosene fraction 31, diesel stream 32 and fractionator bottoms 33. A preferred distillate product has a boiling point range within the temperature range 250° F.–700° F. A gasoline or naphtha fraction having a boiling point range within the temperature range $C_5$–400° F. is also desirable.

What is claimed is:

1. An integrated hydroconversion process having at least two stages, each stage possessing at least one reaction zone, comprising:

(a) combining a first refinery stream with a first hydrogen-rich gaseous stream to form a first feedstock;

(b) passing the first feedstock to a reaction zone of the first stage, which is maintained at conditions sufficient to effect a boiling range conversion, to form a first reaction zone effluent comprising normally liquid phase components and normally gaseous phase components;

(c) passing the first reaction zone effluent of step (b) to a heat exchanger or series of exchangers, where it exchanges heat with a second refinery stream;

(d) combining the first reaction zone effluent of step (b) with the second refinery stream of step (c) to form a second feedstock;

(e) passing the second feedstock of step (d) to a reaction zone of the second stage, which is maintained at conditions sufficient for converting at least a portion of the aromatics present in the second refinery stream, to form a second reaction zone effluent;

(f) separating the second reaction zone effluent of step (e) into a liquid stream comprising products and a second hydrogen-rich gaseous stream;

(g) recycling at least a portion of the second hydrogen-rich gaseous stream of step (f) to a reaction zone of the first stage; and (h) passing the liquid stream comprising products of step (f) to a fractionation column, wherein product streams comprise gas or naphtha stream removed overhead, one or more middle distillate streams, and a bottoms stream suitable for further processing.

2. The process according to claim 1 wherein the reaction zone of step 1(b) is maintained at conditions sufficient to effect a boiling range conversion of the first refinery stream of at least about 25%.

3. The process according to claim 2 wherein the reaction zone of step 1(b) is maintained at conditions sufficient to effect a boiling range conversion of the first refinery stream of between 30% and 90%.

4. The process according to claim 1 wherein the first refinery stream of step 1(a) has a normal boiling point range within the temperature range 500° F.–1100° F. (262° C.–593° C.).

5. The process according to claim 1 wherein the first refinery stream of step 1(a) is a VGO.

6. The process according to claim 1 wherein at least about 80% by volume of the second refinery stream of step 1(c) boils at a temperature of less than about 1000° F.

7. The process according to claim 1 wherein at least about 50% by volume of the second refinery stream of step 1(c) has a normal boiling point within the middle distillate range.

8. The process according to claim 6 wherein at least about 80% by volume of the second refinery stream of step 1(c) boils with the temperature range of 250° F.–700° F.

9. The process according to claim 1 wherein the second refinery stream of step 1(c) is a synthetic cracked stock.

10. The process according to claim 1 wherein the second refinery stream of step 1(c) is selected from the group consisting of light cycle oil, light gas oil, and atmospheric gas oil.

11. The process according to claim 1 wherein the second refinery stream of step 1(c) has an aromatics content of greater than about 50%.

12. The process according to claim 11 wherein the second refinery stream of step 1(c) has an aromatics content of greater than about 70%.

13. The process according to claim 1 wherein the reaction zone of step 1(b) stage is maintained at hydrocracking reaction conditions, including a reaction temperature in the range of from about 340° C. to about 455° C. (644° F.–851° F.), a reaction pressure in the range of about 3.5–24.2 MPa (500–3500 pounds per square inch), a feed rate (vol oil/vol cat h) from about 0.1 to about 10 $hr^{-1}$ and a hydrogen circulation rate ranging from about 350 std liters $H_2$/kg oil to 1780 std liters $H_2$/kg oil (2,310–11,750 standard cubic feet per barrel).

14. The process according to claim 1 wherein the reaction zone of step 1(e) is maintained at hydrotreating reaction conditions, including a reaction temperature in the range of from about 250° C. to about 500° C. (482° F.–932° F.), a reaction pressure in the range of from about 3.5 MPa to 24.2 MPa (500–3,500 psi), a feed rate (vol oil/vol cat h) from about 0.1 to about 20 $hr^{-1}$, and a hydrogen circulation rate in the range from about 350 std liters $H_2$/kg oil to 1780 std liters $H_2$/kg oil (2,310–11,750 standard cubic feet per barrel).

15. The process according to claim 1 for producing at least one middle distillate stream having a boiling range within the temperature range 250° F.–700° F.

16. An integrated hydroconversion process having at least two stages, each stage possessing at least one reaction zone, comprising:

(a) combining a first refinery stream with a first hydrogen-rich gaseous stream to form a first feedstock;

(b) passing the first feedstock to a reaction zone of the first stage, which is maintained at conditions sufficient to effect a boiling range conversion, to form a first reaction zone effluent comprising normally liquid phase components and normally gaseous phase components;

(c) passing the first reaction zone effluent of step (b) to a heat exchanger or series of exchangers, where it exchanges heat with other refinery streams;

(d) passing the effluent of step (c) to a hot high pressure separator, where it is separated into a liquid stream which is passed to fractionation, and a gaseous stream, which is combined with a second refinery stream which comprises light cycle oil, light gas oil, atmospheric gas oil or mixtures of all three;

(e) passing the combined gaseous stream of step (d) to a reaction zone of the second stage, which is maintained at conditions sufficient for converting at least a portion of the aromatics present in the second refinery stream, to form a second reaction zone effluent;

(f) separating the second reaction zone effluent of step (e) into a liquid stream comprising products and a second hydrogen-rich gaseous stream;

(g) recycling at least a portion of the second hydrogen-rich gaseous stream of step (f) to a reaction zone of the first stage; and (h) passing the liquid stream comprising products of step (f) to a fractionation column, wherein product streams comprise a gas or naphtha stream removed overhead, one or more middle distillate streams, and a bottoms stream suitable for further processing.

* * * * *